US007065806B2

(12) United States Patent
Reichel et al.

(10) Patent No.: US 7,065,806 B2
(45) Date of Patent: Jun. 27, 2006

(54) SHOWER PARTITION AND SHAPED SECTION FOR THE SAME

(76) Inventors: Günter Reichel, Steinhardtweg 9, 35232 Dautphetal (DE); Jürgen Reichel, Steinhardtweg 9, 35232 Dautphetal (DE)

( * ) Notice: Subject to any disclaimer, the term of this patent is extended or adjusted under 35 U.S.C. 154(b) by 344 days.

(21) Appl. No.: 10/239,988

(22) PCT Filed: Mar. 23, 2001

(86) PCT No.: PCT/EP01/03348

§ 371 (c)(1),
(2), (4) Date: Jan. 17, 2003

(87) PCT Pub. No.: WO01/74224

PCT Pub. Date: Oct. 11, 2001

(65) Prior Publication Data

US 2003/0145529 A1 Aug. 7, 2003

(30) Foreign Application Priority Data

Apr. 3, 2000 (DE) ..... 200 05 982 U

(51) Int. Cl.
*A47K 3/22* (2006.01)
*A47K 3/34* (2006.01)
*A47K 3/36* (2006.01)

(52) U.S. Cl. ..... 4/607; 4/557
(58) Field of Classification Search ..... 4/557, 4/600, 607, 608, 610, 612, 614
See application file for complete search history.

(56) References Cited

U.S. PATENT DOCUMENTS 5,480,199 A * 1/1996 Husting ..... 4/607
6,035,460 A * 3/2000 Borter ..... 4/607

FOREIGN PATENT DOCUMENTS

| | | | |
|---|---|---|---|
| DE | 4015994 | | 5/1990 |
| DE | 4202757 | | 1/1992 |
| DE | 29504715 | | 3/1995 |
| DE | 4441048 | | 5/1995 |
| DE | 29600610 | | 1/1996 |
| DE | 29700488 | | 1/1997 |
| DE | 29803966 | U1 * | 4/1998 |
| EP | 0457072 | | 11/1991 |
| EP | 0855163 | | 12/1997 |
| EP | 852925 | A1 * | 7/1998 |
| EP | 853914 | A1 * | 7/1998 |

* cited by examiner

*Primary Examiner*—Tuan Nguyen
(74) *Attorney, Agent, or Firm*—Clark & Brody

(57) ABSTRACT

A profiled unit (10) for a shower partition door (S) is mounted for rotation about an off-center vertical axis (A) and accommodates, in longitudinal grooves (12, 14) on either side, partial leaves (22, 24) whose position relative to each other is adjustable in at least two directions. At the front and/or rear, flat elements (30, 38) are lockable into a profiled element (11), whose ends accommodate pivot bearings (26, 28) between which the profiled unit (10) can be raised or lowered even during its rotation and can be locked in position in at least one door position. An adjustable and lockable supporting plate (50) sits below the bottom pivot bearing (26). Above this, the door rests on a preloadable spring assembly (F) that includes a compression spring (67) that can be contracted and released in order to lower or raise said door (S), respectively.

21 Claims, 8 Drawing Sheets

SHOWER PARTITION AND SHAPED SECTION FOR THE SAME

Figure 1:
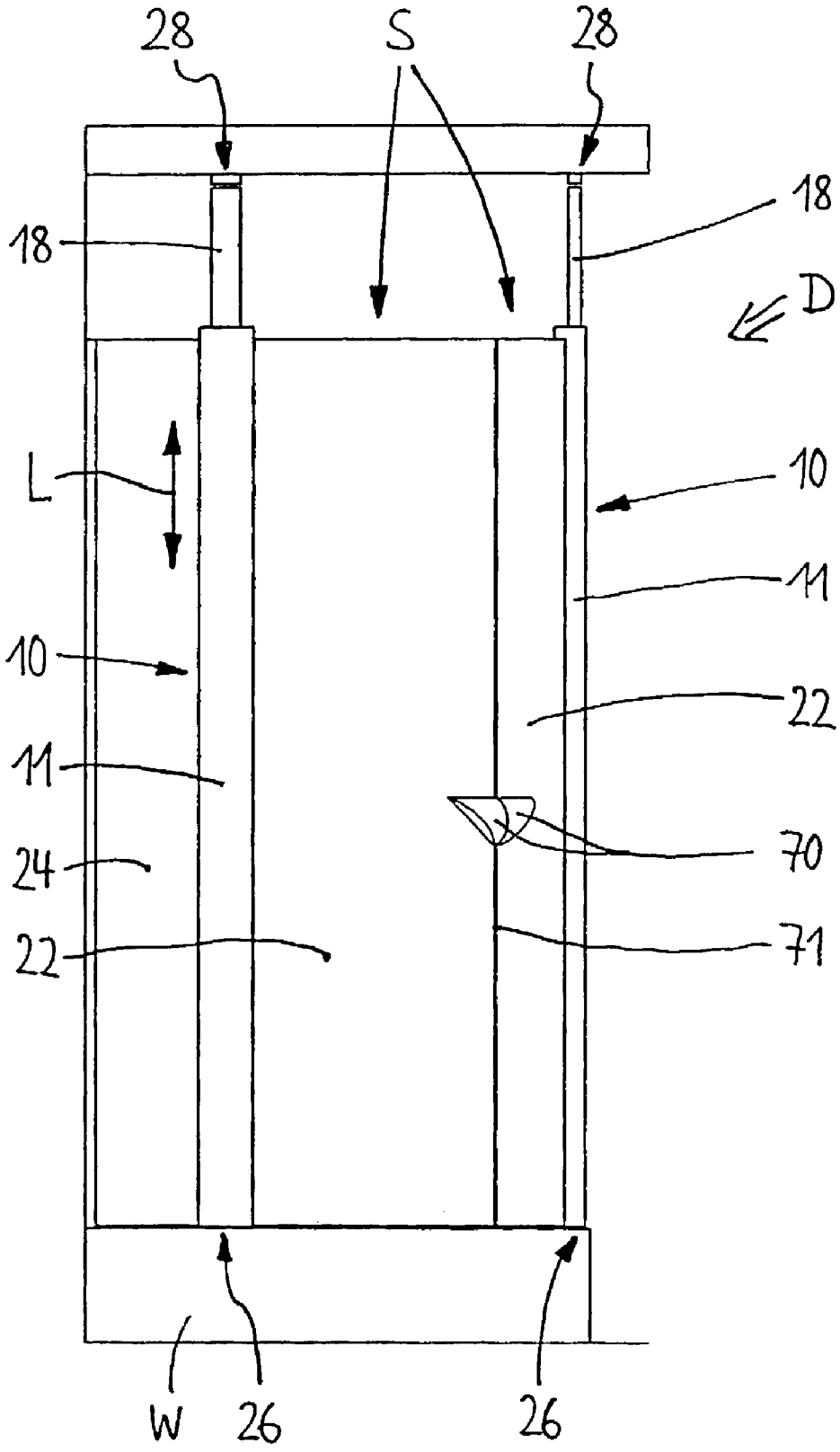

The invention relates to a profiled unit for a shower partition door and also to shower partitions containing the profiled unit.

Shower partitions usually possess a profiled frame which surrounds the shower chamber and is adjustably fixed to a room wall, for example by means of lateral profiled elements, and is firmly attached via a profiled base unit to the edge of a shower basin or bathtub. The doors are in the form of sliding doors or swing doors and have glass or plastics panes that may be enclosed in frame profiles. Sealing means between the profiled door and frame elements prevent the escape of water from the interior of the shower cubicle or bathtub.

Some of the profiled frame and door elements are of considerable width, which fact can be unsatisfactory from an esthetic point of view and reduces the amount of transparent area available. Thus in order to allow as much light as possible to pass into the shower cubicle from outside and to make the frame structure inconspicuous as a whole, attempts are being made to reduce the profiled frame to as few elements as possible and to avoid the necessity of a door frame by implementing the glass or plastics panes themselves as wall elements or door elements. Thus, for example, a pane of glass has been hingedly attached to a profiled wall element by means of a lateral profiled unit. A profiled sealing strip carrying a magnetic strip is mounted onto the closing edge of said glass pane, whilst its bottom edge is provided with only a narrow antisplash strip.

A shower partition disclosed in DE 295 04 715 U1 has a profiled frame composed of a lower base profiled element fixed horizontally on the edge of a shower basin and of lateral profiled frame elements between which a swing door is mounted for rotation about an axis offset toward the door center. The door has profiled joining elements that are mounted laterally on the door edges and engage the profiled frame elements in close fit when the door is closed so that optically only one uniform profiled element will appear. The pivot bearings are likewise not directly visible. A bottom pivot bearing is hidden below the profiled base unit while a top pivot bearing is attached to the top edge of the door by means of a short accommodating head only. Other structures of glass dispense entirely with profiled frame and door elements. In the top and bottom regions of the door side edges, only individual hinges are situated which are mounted on a room wall or a glass partition element. However, a problem here is that the total weight of the relative heavy glass doors must be carried by the top hinges so that high wear on the joints and possibly also glass fracture may result. Subsequent width adjustment of the shower partition to adapt the latter to different room dimensions is possible either not at all or only within narrow limits via the fittings of the glass partition elements. This is not always adequate.

In order that the bottom edge of the door or a profiled sealing strip fixed thereto will not hinder opening and closing of the shower cubicle, swing doors have been mounted such that they are vertically displaceable in addition. DE 42 02 757 C2 discloses in this respect a guide strip to be fixed on the side near the wall in order to receive a displaceable profiled bar. To the latter, a door is hingedly attached which can be moved from an upper to a lower position, whereby inter-engaging profiled sealing strips effectively prevent the escape of shower water. A lifting device actively connected to the shiftable profiled bar via a cable or a lever arm makes it possible to raise the door so that it can be freely swung past the profiled sealing strips. In order to reduce the force required to raise the door, a pneumatic spring absorbs the major part of the door. Assembly and installation require quite an effort and expenditure. The guide strip and profiled bar are relatively broad, which considerably spoils the overall appearance of the frame or shower partition.

It is an object of the present invention to reduce the number of profiled elements of a shower partition to a minimum and to guarantee permanently reliable precision bearing and sealing of the door elements. Adjusting means are to be available for adaptation of the shower partition to different room dimensions and installation conditions. Shower partitions made with the profiled elements shall be of simple structure and cheap to produce. It is likewise desired to install and use them both quickly and easily.

In a profiled unit for a swing door of a shower partition, which door is mounted for rotation in pivot bearings about a vertical axis displaced toward the center of said door, the invention provides that the profiled unit extends between said pivot bearings over at least part of the vertical extension of the swing door and accommodates a door leaf which is split in a direction parallel to said rotation axis. Thus except for the profiled unit disposed between the door leaf parts, the swing door requires no other profiled frame or edge members to be placed in or on lateral wall parts. The size of the profiled door element between the pivot bearings is reduced to a minimum, whilst the free door area allows plenty of light to penetrate into the interior of the shower cubicle. Since the pivot bearings are flush with the top and bottom of the profiled unit, no further structural components or other visible obstructions will disturb the appearance.

Another aspect of the invention includes a profiled unit for a shower partition swing door of the aforementioned type. The invention provides, opposite a longitudinal groove in the profiled unit, a second longitudinal groove in which another continuous flat element can be inserted which is of the same shape as, or a similar shape to, said door leaf. The swing door mounted in the profiled unit can thus in a surprisingly simple manner be broadened by, say, the breadth of a side member, without requiring the use of any additional or supplementary profiled units or frame parts. This results in interesting designs of shower partitions which may also be conveniently installed over showertubs or bathtubs.

A significant feature of the invention for which independent protection is claimed. According to said claim, partial leaves forming the door leaf and held on either side in grooves of the profiled unit are positionally adjustable in at least two dimensions relative to each other within the longitudinal grooves of the profiled unit. One result of this is that it is possible to subsequently alter the breadth of the swing door, ie the entire shower partition can be individually adapted to given room dimensions. Since, if required, both door leaves can be adjusted, the adjustment range is extremely large, although the entire door includes only a single, relatively narrow profiled unit. Another result is that the door leaves, and particularly the door leaf edges, can be adapted to the run of the room walls. If these are for example slightly inclined or sloping, which is not rare, the door leaf on the side near the wall can be appropriately positioned, while the partial leaf affording main entrance into the shower cubicle can be independently adjusted.

In another aspect of the invention, flat elements are insertable into or attachable to a profiled element of the profiled unit, at the front and/or rear thereof, primarily by means of frictional and/or form-fitting connections. This opens opportunities for variegated designs, specifically for the use of differently colored and/or mirrored flat elements to match surrounding furnishing and for the use of supplementary functional elements such as soap dishes, handgrips, hooks, rotary handles and the like, which can be subsequently fitted inside or outside the shower partition as desired.

Preferably the profiled unit of the invention is used in shower partitions for attachment to a shower basin, showertub or bathtub. At least one such profiled unit is mounted, in a bottom pivot bearing so that the entire weight of the swing door is absorbed vertically, and thus substantially without shearing or cross forces, by the edge of the basin and via the same by the floor. In this manner permanently reliable and precise support is guaranteed. Since the partial leaves of the swing door can be positionally adjusted relative to each other and can be individually adapted to the room dimensions, there is always optimal leakproofing against splash water. The shower partition exhibiting only one profiled unit per door is very simply constructed and can be easily set up even by untrained personnel.

Of further significance is a technique whereby for affording base support for the profiled unit together with its adjustable pivot bearing on a supporting surface, eg the floor or an edge of a shower basin or showertub, a mounting or supporting plate is provided which can be positionally adjusted and locked for alignment of the door. Preferably adjusting means are present which have screw-threaded elements for accommodation of adjusting and locking screws or alternatively articulated suckers for compensating inclines and angular or height deviations. Once the correct position of the swivel joint and thus of the door has been achieved by said adjustment, this state can be secured by, say, adhesive bonding, and any gap found underneath the mounting plate can be sealed up with the adhesive or a silicon compound.

For the purpose of raising and lowering a shower partition door, the invention further provides that the bottom pivot bearing carries a spring assembly on which the weight of the door rests and which is manually preloadable, specifically by means of a handwheel for adjustment of the position of an eccentric, whereby a cable suspended therefrom contracts or releases a compression spring mounted between two inter-rotatable sleeves. This extremely simple design allows for easy raising and lowering of even very heavy doors.

Figure 2:
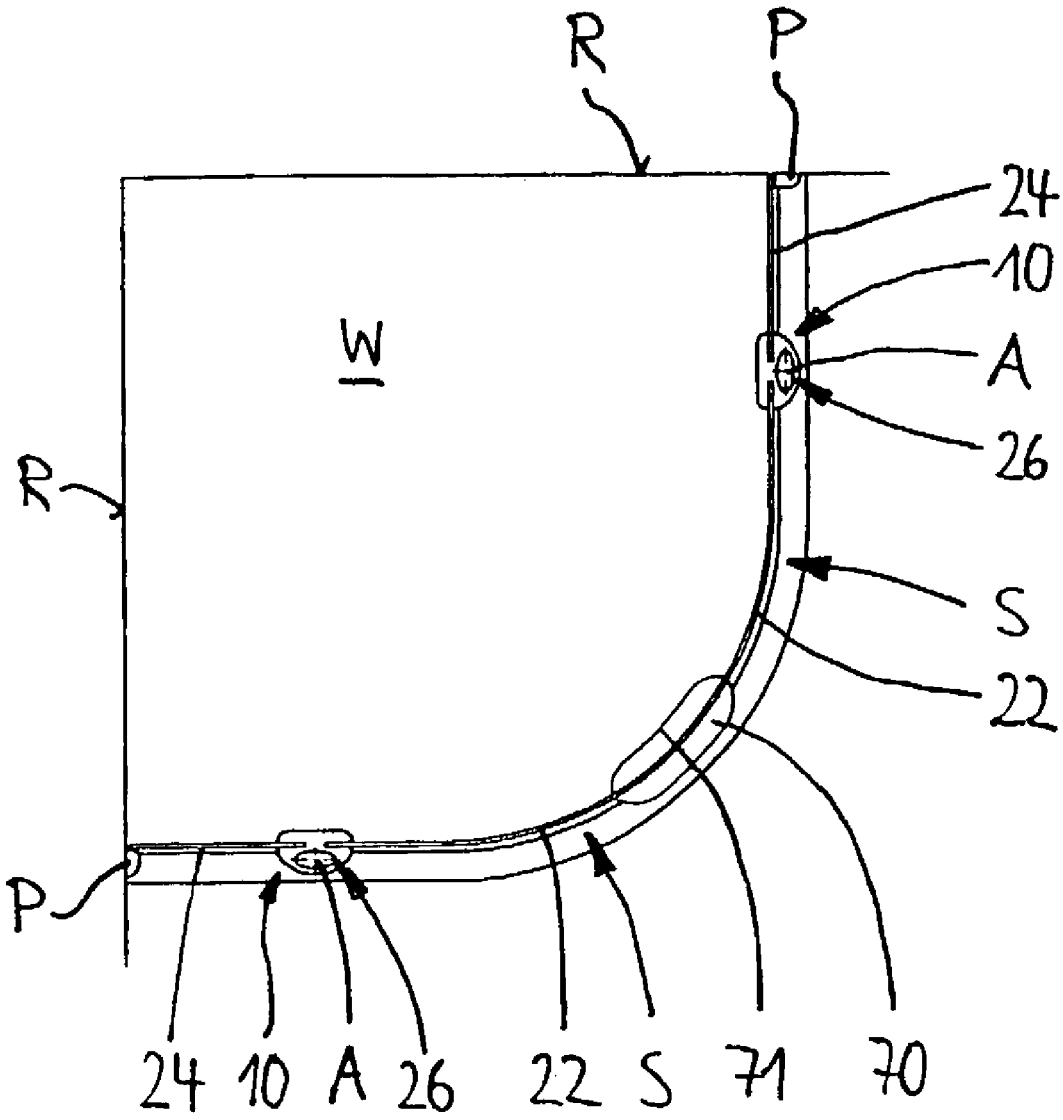
Figure 3:
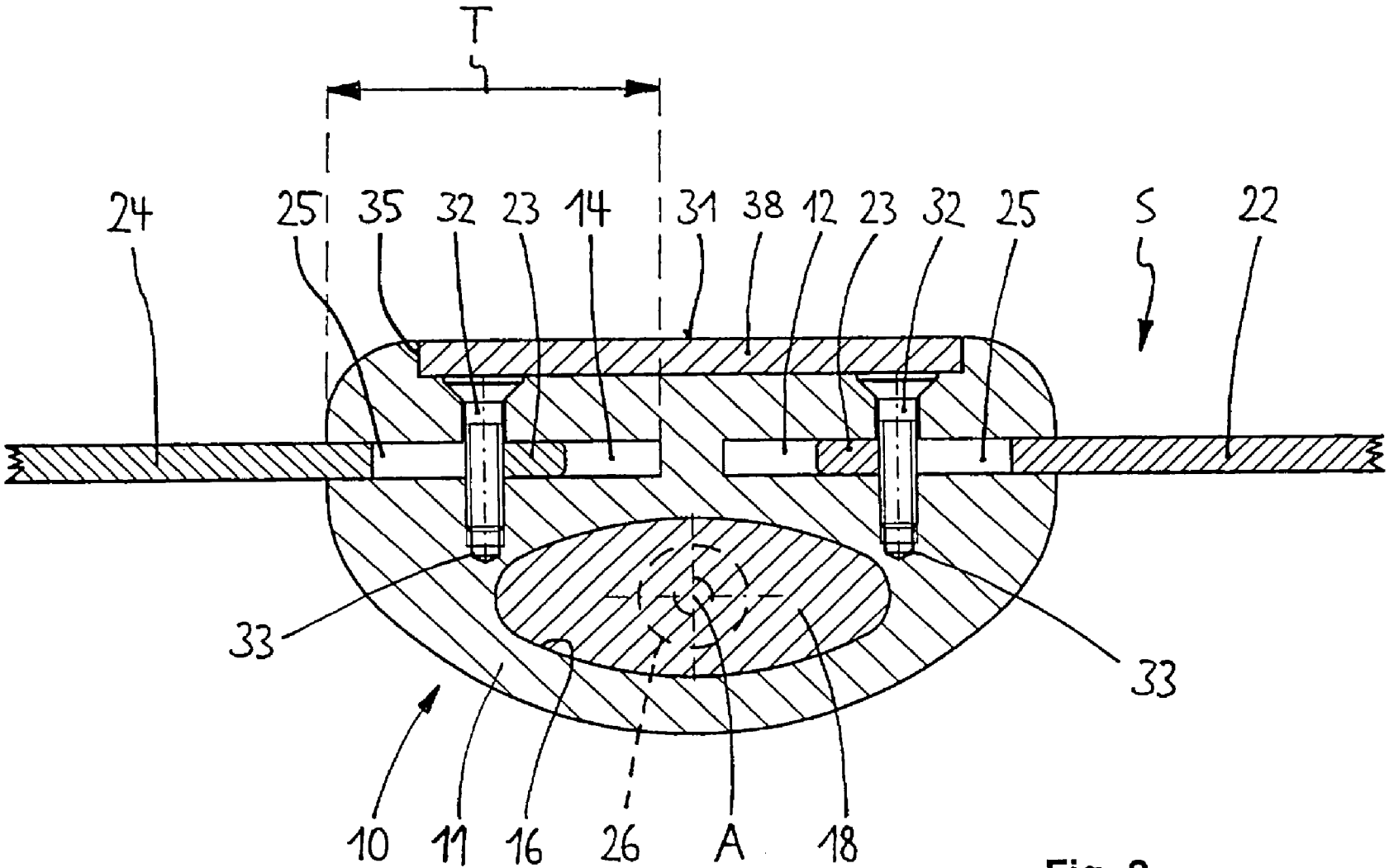
Figure 4:
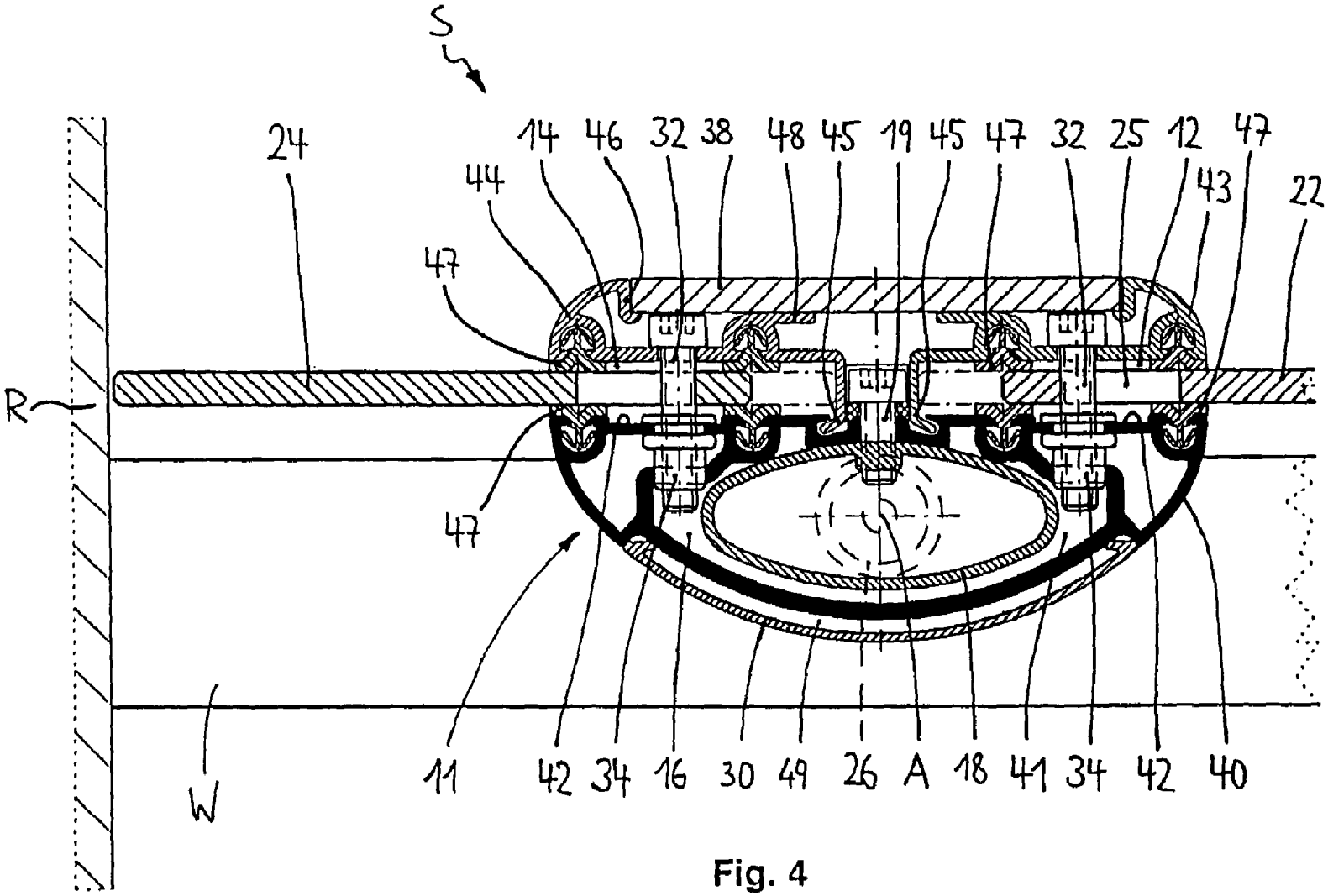
Figure 5:
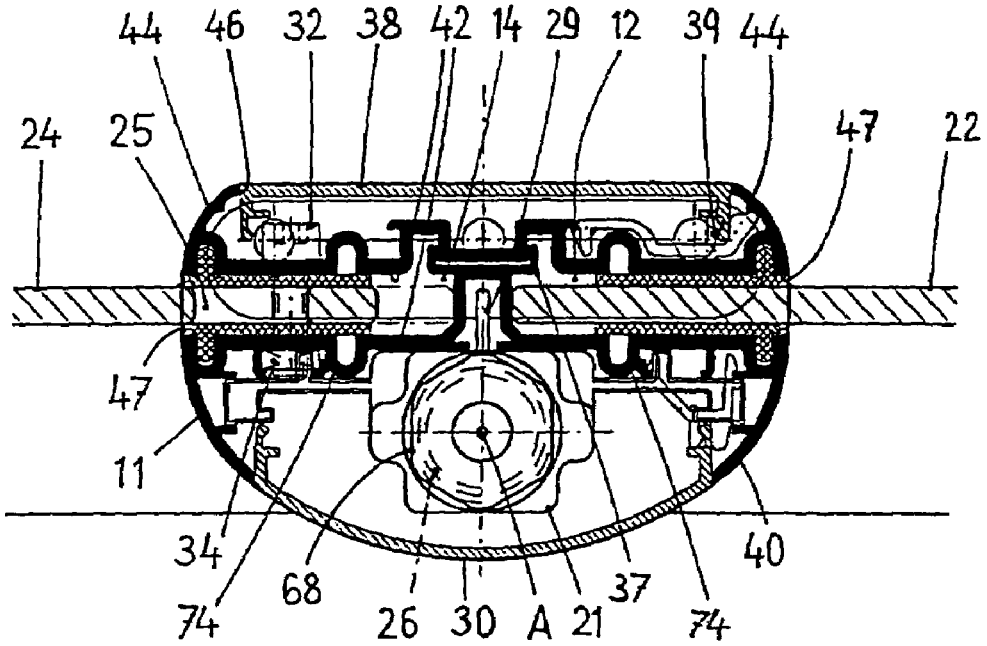
Figure 5:
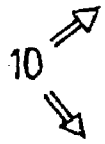
Figure 6:
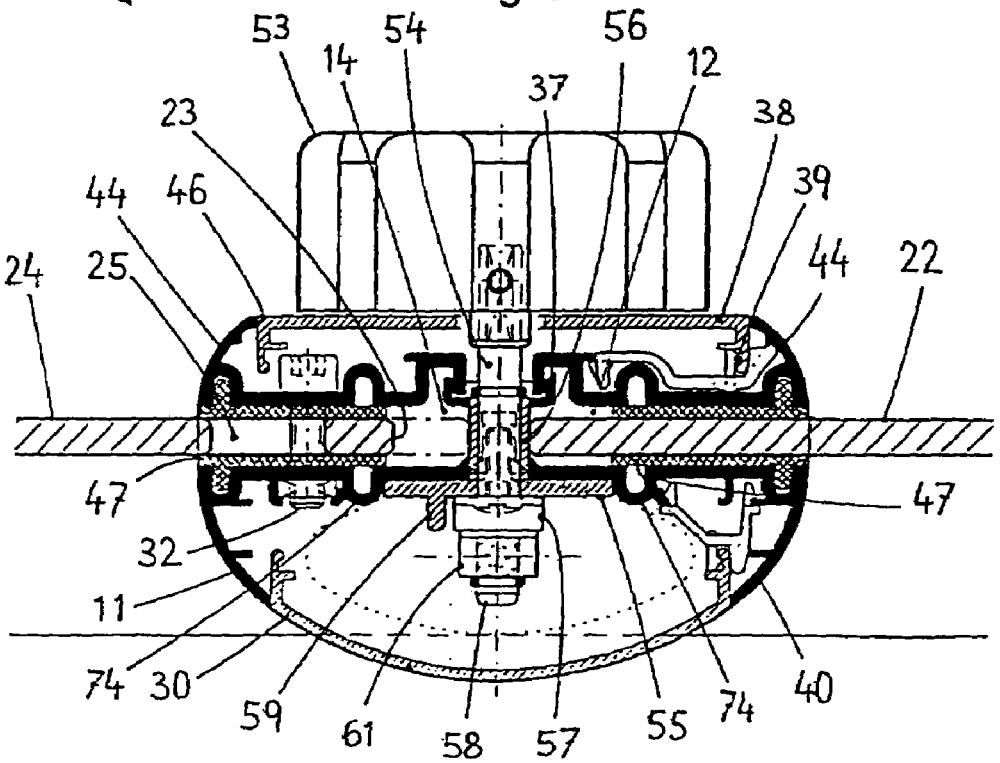
Figures 7A, 7B:
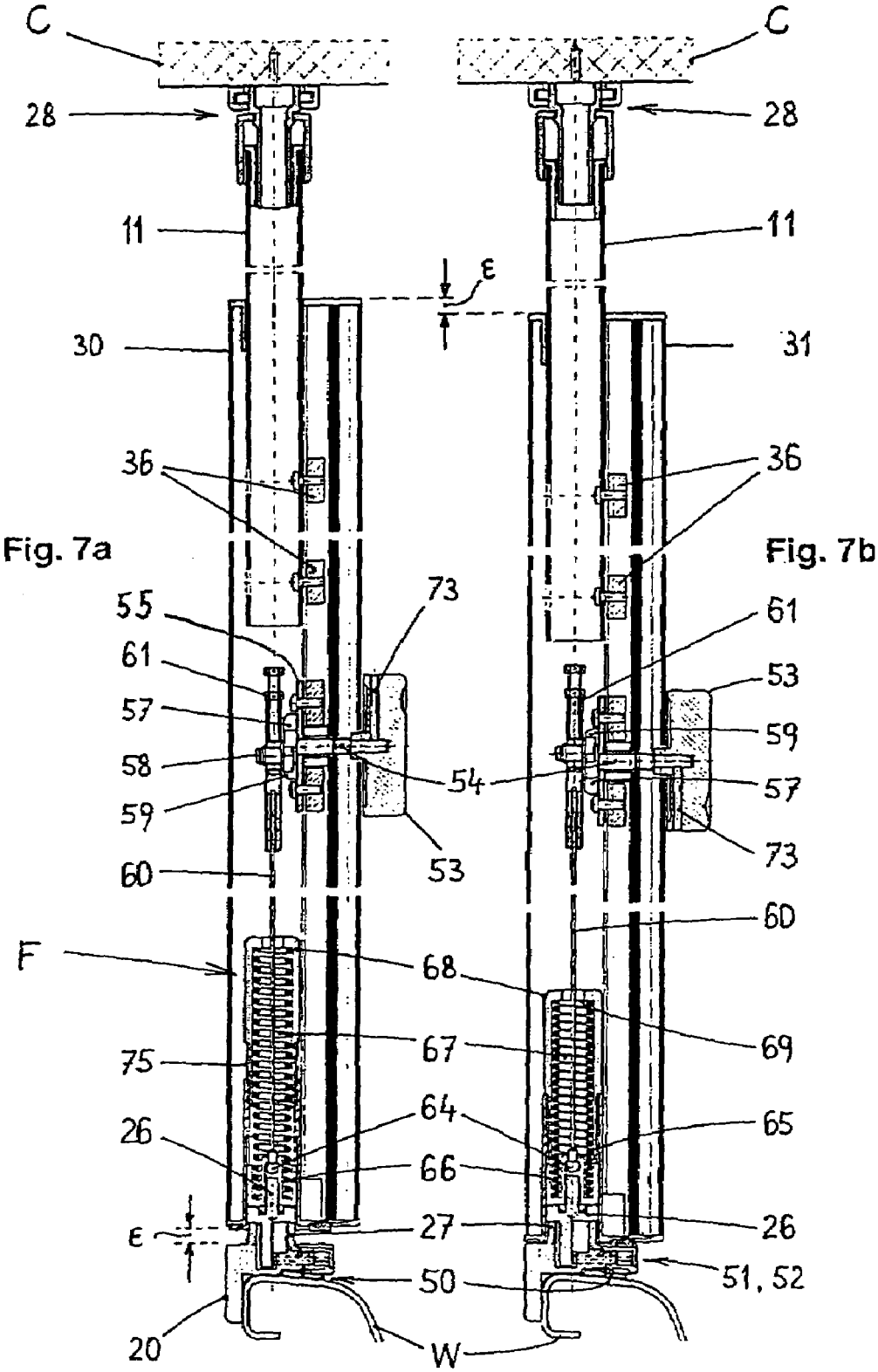
Figures 8A, 8B:
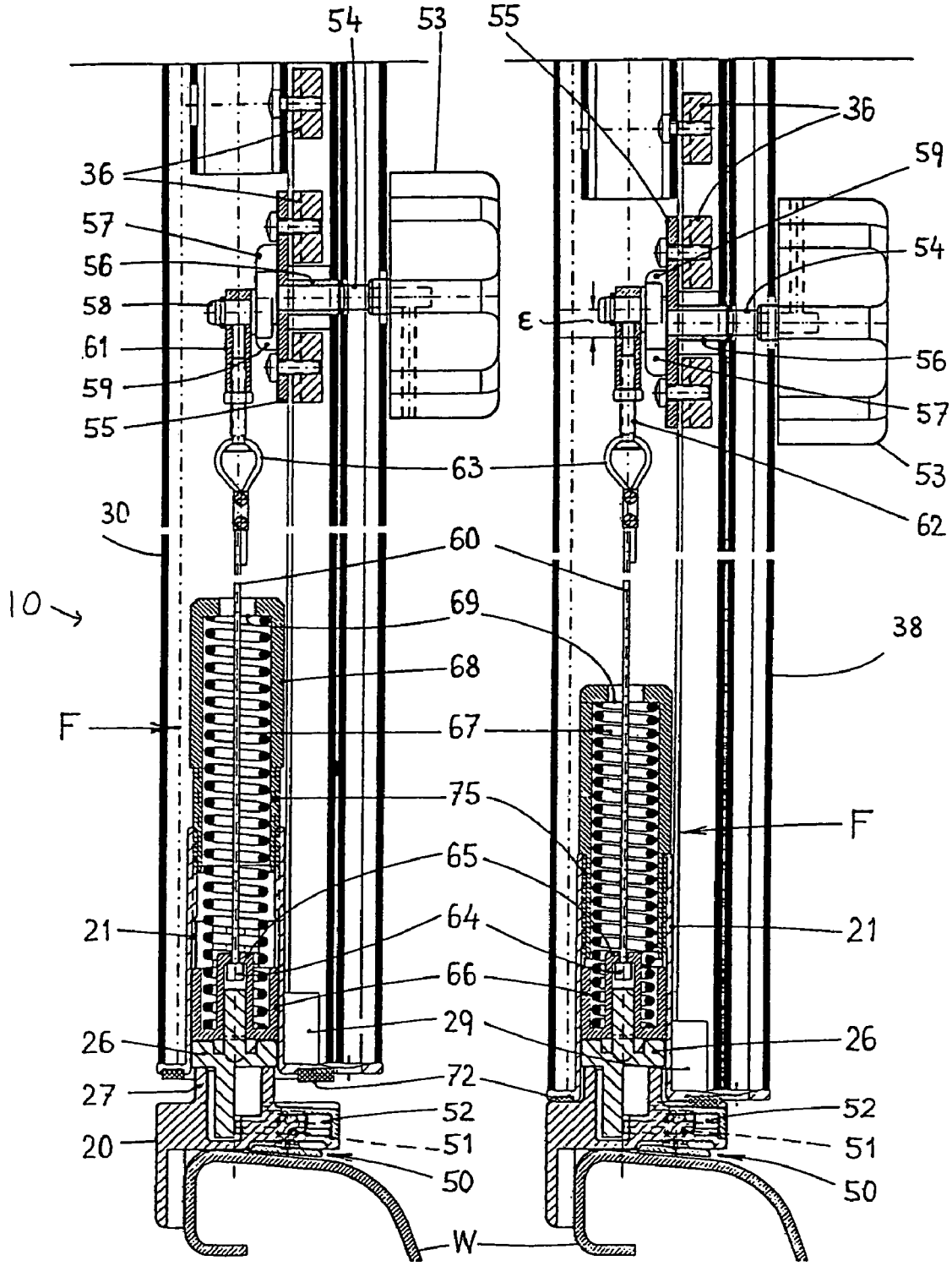

Further features, details, and advantages of the invention may be gathered from the wording of the claims and from the following description of working examples bearing reference to the drawings in which:

FIG. 1 is a front view of a shower partition,

FIG. 2 is a horizontal sectional view of the shower partition of FIG. 1, FIG. 3 is a partial cross-sectional view of a swing door containing a profiled unit, FIG. 4 is a partial cross-sectional view of another swing door with a profiled unit, FIG. 5 is a partial cross-sectional view of another profiled unit, FIG. 6 is a partial cross-sectional view of yet another profiled unit, FIGS. 7*a* and 7*b* are longitudinal section views of a door assembly comprising a profiled unit of FIG. 6, in two different door positions, FIGS. 8*a* and 8*b* are enlarged partial views corresponding to FIGS. 7*a* and 7*b*, FIGS. 9*a* and 9*b* are partial rear views of a profiled unit according to FIG. 6 in two different settings corresponding to the positions of FIGS. 7*a*, 8*a* and 7*b*, 8*b*, respectively.

FIG. 1 shows, for example, a shower cubicle or shower partition D for a corner shower, which is mounted on the top edge of a showertub or shower basin W and has two swing doors S each rotatably mounted in a bottom bearing 26 and a top bearing 28. Each of the doors S has a split door leaf 22, 24 of glass and a profiled unit 10 connecting the partial leaves 22, 24. The latter extends between the pivot bearings 26, 28 preferably over the entire height of swing door S and also somewhat beyond. However, the profiled unit 10 may, if required, end flush with the top edge of door S. It is important to ensure that it is parallel to a rotation axis A which is displaced toward the center of the door due to the fact that the door leaf 22, 24 is divided into two parts. This makes it possible to open door S even where there is little room, eg if room fittings, such as cupboards, wash basins or the like should obscure part of the front of the door.

The partial leaves 22, 24 accommodated by the profiled unit 10 on either side thereof form, as shown in FIG. 2, in the side areas of corner shower D, a substantially plane door surface which, in the direction of the closing edges 71 of doors S, is curved to assume the same or similar shape as the shower basin W and comprises no further profiled edge pieces except for profiled units 10 so that the frame optics are reduced to a minimum and plenty of light reaches the interior of shower cubicle D. Each door leaf 22, 24 may carry handling means 70 at its closing edge 71 where magnetic elements (not shown) can be enclosed in closing edges 71 of the door S or in handles or parts thereof extending flush therewith, in order to keep the swing door S sealed in its closed position. Where the shower basins W are differently shaped, the door leaves or partial leaves 22, 24 may form an overall plane or even curved door surface or they may be at an angle to each other, depending on the room characteristics and the shape of the basin.

As the doors S are opened outwardly via the handles 70, the partial leaves 22 adjacent each other swing outwardly while the partial leaves 24 acting as side members of shower partition D swing inwardly. Alternatively, it is possible to open the doors inwardly so that their partial leaves 24 swing outwardly. The easy-to-clean swing doors S permit convenient access to the interior of the shower partition D at all times.

In the embodiment shown in FIG. 3 the profiled unit 10 includes a single-piece profiled element 11 which has an approximately oval or lenticular cross-section and a flattened rear portion 31. At the lower and upper ends of the profiled unit 10 there are recesses 16 in the end faces of the profiled element 11 to accommodate pivot bearings 26, 28. The bottom pivot bearing 26 (not shown) is completely hidden by the profiled unit 10 or its profiled element 11, ie it is not visible from outside. Bearing parts (not shown) of the pivot bearing 26 have inclined slip planes which, as the swing door S is rotated about axis A, force the profiled unit 10 to rise during the opening operation and to fall when the door is closed, without damaging the bottom edges of the door. In its closed position, door S is held securely over the edge of the basin so as to form a seal therewith.

In order to brace profiled unit 10 at its top end, where the pivot bearing 28 is accommodated in recess 16, it is preferably held by a bracket (not illustrated) fixed to a wall R of the room, for example a bathroom wall. Alternatively, as shown in FIG. 1, a telescopic extension 18 may be provided in the upper recess 16 reaching to below a ceiling or a ceiling-like projection C where it engages the pivot bearing 28. It is important to ensure that the profiled unit 10 functioning as a continuous hinge has its upper end in such a position that the pivot bearings 26, 28 are in vertical alignment along rotation axis A.

It will be seen from FIG. 3 that two longitudinal grooves 12, 14 are provided in the profiled element 11 of the profiled unit 10 for accommodation of the partial leaves 22, 24 at the side, the width of said grooves being approximately equal to the thickness of the partial leaves 22, 24. In a longitudinal direction L of the profiled element 11, there are provided—preferably at equidistant intervals—fixing or locking screws 32 which pass through each longitudinal groove 12, 14 for engagement of screw-threaded bores 33 within the profiled element. In accordance with the arrangement of the clamping screws 32, each partial leaf 22, 24 inserted in longitudinal groove 12, 14 assigned thereto is provided, along its longitudinal edge 23, with round or oblong bores 25 (at right angles to the longitudinal direction L), the diameter or length and/or width of which being greater than the outside diameter of the locking screws 31. If these screws are firmly tightened, the partial leaves 22, 24 are sealingly locked to the profiled element 11 within the longitudinal grooves 12, 14. On the other hand, as the screws are loosened, the position of the partial leaves 22, 24 can be adjusted—within the limits dictated by the bores 25 and the depth of groove T—relative to each other and relative to the profiled unit 10 supported by pivot bearings 26, 28.

A decisive advantage of this arrangement is that the swing doors S can be adapted to different local conditions because each door leaf 22, 24 lends itself to width adaptation due to ist two-parts design. Alternatively, the vertical and lateral positions relative to the edge of the basin or relative to room wall R may be separately optimized for each partial leaf 22, 24 so that the shower partition D can be installed and adjusted as a water-tight unit with or without the use of additional profiled sealing strips P attached to the glass edges of the partial leaves 22, 24 or—as indicated in FIG. 2—attached to room wall R. The simply designed adjustment means are easy to handle. Another advantage is that both partial leaves 22, 24 can be mutually adjusted within the profiled unit 10, ie the entire door S covers a very large width range based on the size of the relatively narrow profiled unit 10. Consequently the overall dimensions of the shower partition can be readily changed and individually adapted to often very different room characteristics.

For preventing the locking screws 32 from being visible or accessible from the outside, a cover strip 38 is let into the rear surface 31 of the profiled element 11, which strip is held in a recess 35 so as to be frictionally locked and form-fitting and be flush with the surface of the rear side 31 of the profiled element 11.

In order to support the profiled unit 10 at the bottom and the adjustable pivot bearing 26 disposed therein, a base plate or support plate 50 may be provided (cf FIGS. 7*a*, 7*b* and 8*a*, 8*b*), which engages a bottom supporting surface, eg the floor or an edge of a shower basin or showertub, and which can be adjusted and fixed for alignment of door S. Preferably the plate 50 comprises screwing elements, eg an adjusting screw 51 and a grub screw 52 in order to be able to compensate for inclines and general angular or height deviations in an advantageous and precise manner. Once the correct position of door S has been achieved by adjustment of the pivot bearing 26, this state can be secured, for example by adhesive bonding. Any gap found underneath the base plate 50 can be closed and sealed off with adhesive or with a silicon compound.

In another embodiment, the profiled element 11 of the profiled unit 10 includes a plurality of component parts. According to FIG. 4 it has a main profiled member 40 comprising a central channel 41 and clamping surfaces 42 at the rear and also two profiled clamping elements 43, 44, each of which is locked in the main profiled member 40 by means of its hooked ends 45 pointing toward the rotation axis A. Lateral longitudinal grooves 12, 14 accommodate the partial leaves 22, 24 between the main profiled member 40 and the profiled clamping elements 43, 44. Locking screws 32 are screwed into main profiled member 40 at equidistant intervals in the longitudinal direction L, which member may have special screw-threaded inserts 34 for this purpose. Several sealing elements 47 are provided on the clamping surfaces 42 of the main profiled member 40 and also on the insides of the profiled clamping elements 43, 44 in order to seal the door leaf parts 22, 24 from the profiled element 11. Hinging of the profiled unit 10 or the main profiled member 40 is made possible by the recesses 16 provided in central channel 41 for the pivot bearings 26, 28 or the extension 18, in which case at least one screw 19 provided between the profiled clamping elements 43, 44 serves the purpose of fixing the necessary draw-out degree of extension 18.

The mode of operation of the two-part profiled element 11 corresponds to that of the integral profiled unit, ie by loosening the screws 32 it is possible to adjust the positions of the partial leaves 22, 24 within the longitudinal grooves 12, 14 relative to each other and relative to the profiled parts 40, 43, 44. Tightening the screws 32 causes the profiled clamping elements 43, 44, tiltably mounted by means of their hooked ends 45, to be pulled against the clamping surfaces 42 of the main profiled member 40 and thus to be firmly pressed against the partial leaves 22, 24. A flat element clipped into the rear 31 of profiled element 11 to form a cover strip 38 conceals clamping screws 32 and locking screws 19. For this, the profiled clamping elements are provided at the rear with clamp springs 46 and with bearing surfaces 48.

The longitudinal grooves 12, 14 of the profiled unit 10 are preferably in line in a single plane. They may alternatively be in staggered relationship in a row and fixed by a common clamping device, whereby the profiled unit 10 can be made even narrower. Another possibility is that the longitudinal grooves 12, 14 in the profiled unit 10 are at a preferably obtuse angle to each other so that door S has an angular form due to their partial leaves 22, 24. Curved shapes are also possible.

For technical and/or esthetic reasons, the front of the profiled unit 10 may be provided with decorative or colored strips in the form of flat elements 30 accommodated in recesses 49 at the profiled element 11 or at the main profiled member 40 where they are tensionally locked and/or interlocked. Each flat element 30 can, over its entire length or if necessary over portions thereof be in reentrant, flushed, or projecting relationship with said profiled element 11 or the main profiled member 40. Another very advantageous feature comprises the possibility of attaching to the flat elements 30, 38 any desirable decorations, labels or even fittings such as soap dishes, towel holders, mirror holders, rotary handles and the like.

In the embodiment shown in FIG. 5, the profiled unit 10 has a profiled element 11 forming an open C in cross-section and closed at the front by a curved flat element 30, which is fixed in position by a snap-action catch 39. The partial leaves 22, 24 of the door are kept in place between clamping surfaces 42 by means of broad, partially ribbed sealing elements 47 in the region of longitudinal grooves 12 or 14, and a screw 32 passes through bore 25 to engage its counterpart 34 to allow for adjustment of the partial leaf 24. Fixing is attained by fitting the profiled elements 40, 44 together, using a snapping device 37.

In the cavity of the profiled element 11, there is disposed at the very bottom the pivot bearing 26 covered by a fixed sleeve 21 which is flush with the bottom of profiled unit 10 (cf FIGS. 7*a*, 7*b* and 8*a*, 8*b*). The fixed sleeve 21 has a mating lug 29, serving as anti-twist stop during installation. A polygonal sleeve 68 is also shown the function of which will be explained below.

As best seen in FIGS. 8*a* and 8*b*, the bottom end of the profile unit 10 includes sealing strips 72 opposite a main support 20 which has a bearing block 27 engaged by a bottom pivot bearing 26 of the profiled unit 10.

Figure 9A:
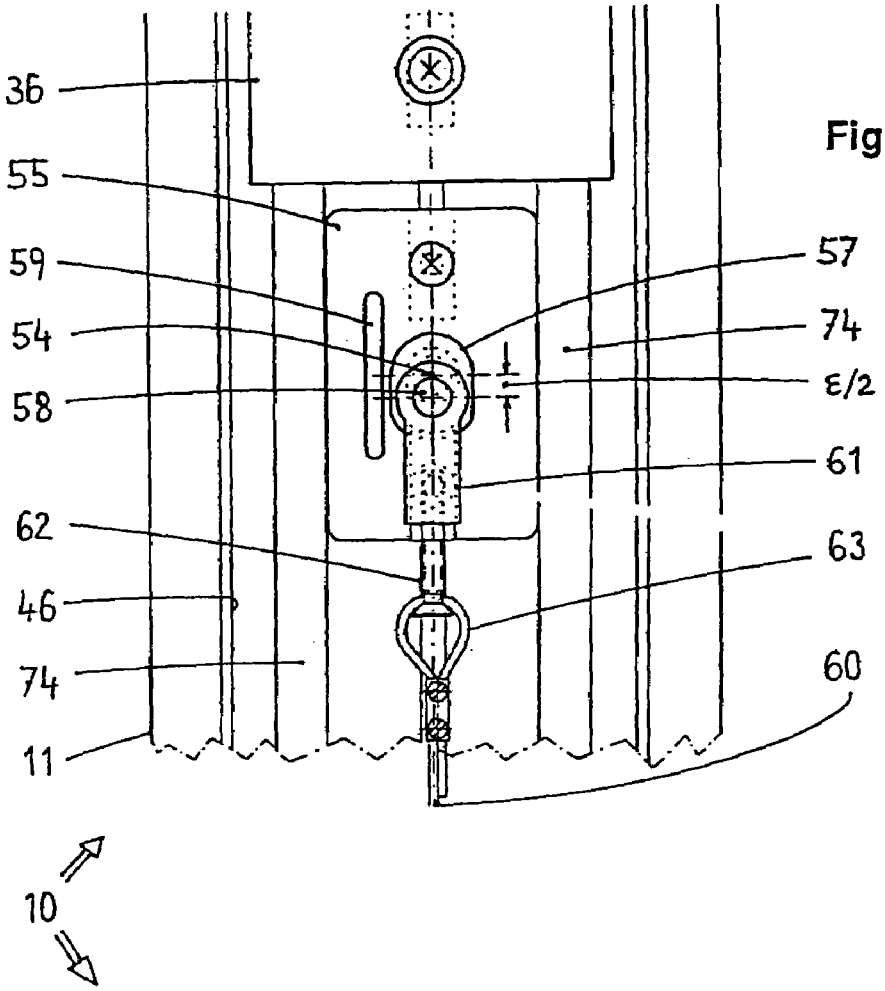

FIGS. 8*a*, 8*b*, and 9*a* show the sliding blocks 36.

The same profiled unit 10 is shown in FIG. 6 in cross-section at the level of a handwheel (FIGS. 7*a*, 7*b* and 8*a*, 8*b*). It will be seen that the handwheel 53, which may have finger rests and a thumb rest around its periphery (cf FIG. 7*a* and 7*b*), is non-rotatably linked by a pin connection 73 to a dog or an entrainer 54 which is mounted in a bearing bush 56 and passes through the cover strip 38 at the rear and the snapping device 37. Bush 56 forms a single unit with a slide element 55 having a fin 59 projecting at right angles therefrom.

Adjacent the slide element 55, there is an eccentric disc 57 which forms a single unit with the dog or entrainer 54 or is rigidly connected thereto and which carries a stay bolt 58 on which a pulling part 61 is mounted. In the working example of FIGS. 7*a*, 7*b*, the pulling part 61 is a bush at the top end of which there is an adjusting screw and at the bottom end there is a clamping element linearly flush therewith, the clamping element holding one end of a cable 60. As may be seen from the enlargements presented in FIGS. 8*a*, 8*b*, a suspension screw 62 may be alternatively inserted in a pulling part 61 which extends only downwards, the suspension screw being vertically adjustable and holding the loop 63 of a cable 60. Instead, use may be made of a metall/plastics linkage system, an aluminium rod or the like.

Cable 60 extends into a spring assembly F whose lower end is formed by a spring cup 66 rotatably mounted on the bottom pivot bearing 26. This is guided in the internally ribbed fixed sleeve 21 in which it is non-rotatable but axially displaceable. Over a screw-threaded portion 75, the fixed sleeve 21 is in screwed connection with a screw-threaded sleeve 68 having the form of a polygon that can be rotated by means of a tool. A compression spring 67 with adjustable preload is disposed between an upper bearing surface 69 of the screw-threaded sleeve 68 and the interior of the spring cup 66. The preload may be regulated by turning the screw-threaded sleeve 68 relative to the fixed sleeve 21 or alternatively by the engagement of a pulling head 64 of the pulling device 60 against a counterbearing 65 of the spring cup 66.

The tensioning mechanism is best seen by comparing FIGS. 7*a* and 8*a* on the one hand, where a profiled unit 10 is shown in a raised position, with FIGS. 7*b* and 8*b* on the other hand, which show the profiled unit 10 in a lowered position. In each case, the left-hand drawing (FIGS. 7*a*, 8*a*) shows the screw-threaded sleeve 68 screwed up a specified distance out of the fixed sleeve 21 so that the compression spring 67 is held at a given preload of, say, 250 N between the spring cup 66 and the bearing surface 69. On the other hand, the right-hand drawings (FIGS. 7*b*, 8*b*) show the screw-threaded sleeve 68 screwed right down into the fixed sleeve 21 so that the compressed compression spring 67 has a preload of, for example, 450 N.

When the handwheel 53 is in a position of rest (FIGS. 7*a*, 8*a*), the eccentric 57 is in such a position that stay bolt 58 is disposed below the axis of entrainer 54. The length of cable 60 is such that the latter is held taut between loop 63 and pulling head 64 (which engages counterbearing 65). This position may also be seen from the position of the pinning means 73 in handwheel 53. In the example illustrated in FIG. 7*a* said pin points upwardly, as does the thumb recess, whereas pin 73 points downwardly in the position of rest, as illustrated in FIG. 8*a*.

As handwheel 53 is rotated, the eccentric 57 and stay bolt 58 move upwardly to a position above the axis of entrainer 54. In this way the spring tension is increased, possibly up to full compression of compression spring 67, and profiled unit 10 is lowered together with the door because spring cup 66 is pulled up within the fixed sleeve 21 (FIGS. 7*b*, 8*b*) and thus the bottom pivot bearing 26, against which the entire spring assembly F bears, rises within the fixed sleeve 21. The radius at which the stay bolt 58 is positioned on the eccentric disc 57 determines an eccentric throw $\epsilon$. It is seen that this simple device is easy to handle and enables raising and lowering of even heavy doors without difficulty.

Figure 9B:
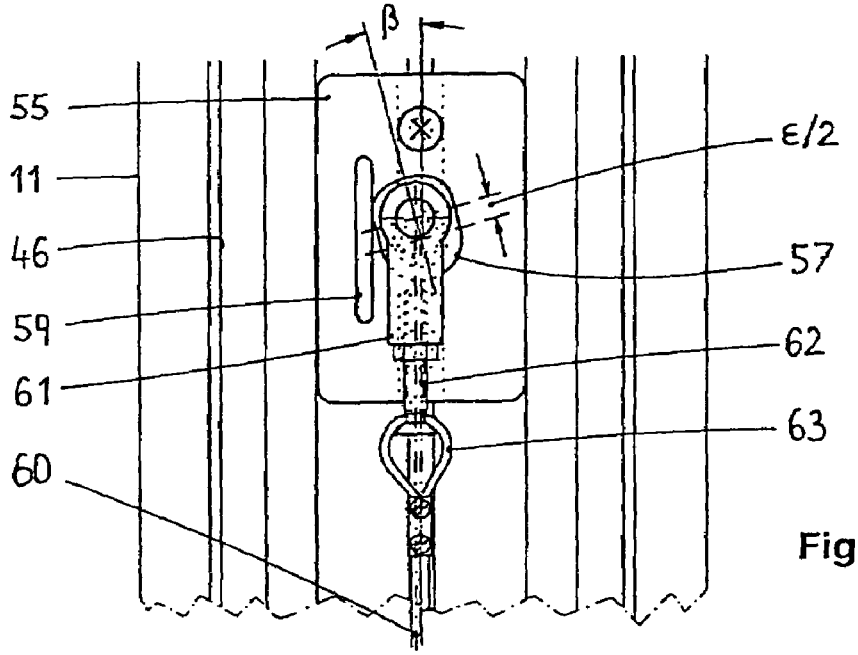

FIGS. 9*a* and 9*b* show that feelable positions of rest can be set with the handwheel 53. The drawings display part of the front of profiled element 11 provided with parallel slide fins 74 which enclose slide element 55 on either side. In the upper drawing (FIG. 9*a*), eccentric 57 is in the position of rest so that stay bolt 58 is below the axis of the dog or entrainer 54 and the pulling member 61 for cable 60 mounted on said stay bolt is under normal preload.

Now the handwheel 53 at the rear can be rotated through more than 180°, whereby case pin 73 moves towards the opposite direction (FIGS. 7*b*, 8*b*). The bearing of pulling member 61 on the stay bolt 58 passes beyond the upper dead center and the cam-like eccentric disc 57 comes to a halt at the vertical fin 59. The resultant deviation from the vertical defines an angle $\beta$ (FIG. 9*b*). Engagement is thus sensed as the profiled unit 10 and consequently door S is lowered. To raise the same, it is first necessary to pass through this locking angle $\beta$ before the previous preload, ie the raised position of the profiled element, is attained by further rotation of the handwheel 53 (FIG. 9*a*).

The invention is not restricted to any of the embodiments described above but can be modified in many ways. For example, the partial leaves 22, 24 of the swing doors S may be of different heights relative to each other and/or relative to the profiled unit 10. It will be seen, however, that in a preferred embodiment a profiled unit 10 for a shower partition door S has or forms an off-center profiled element 11 which takes up at least part of the vertical dimension. The profiled element 11 may be a hollow profiled element comprising one or more parts and accommodating door leaves 22, 24 in longitudinal grooves 12, 14 on either side, which element 11 is mounted at each end in an upper (28) and a lower (26) pivot bearing for rotation about a vertical axis A. The door leaves 22, 24 form swing door S together with the profiled unit 10 which may be of various designs, doing without other frame parts. It is rotatably mounted about an off-center vertical axis A and holds the partial leaves 22, 24 in such a manner that they can be positionally adjusted in at least two directions relative to each other and then be locked in position. At the front and/or the rear, flat elements 30, 38 are be lockable in the profiled element 11, which at each end accommodates pivot bearings 26 and 28, respectively, between which bearings the profiled unit 10 can be raised and lowered during rotation be locked in at least one door position. For alignment purposes there is provided, below the bottom pivot bearing 26, a mounting or supporting plate 50 which may be positionally adjusted and locked. Above this, the weight of the door rests on a preloadable spring assembly F. By means of a handle 53 for a positioning device, a compression spring 67 is arranged for contraction and release, respectively, in order to lower or raise door S. On an eccentric 57 there is provided a pulling member 61 of a pulling device 60—eg a cable, rod linkage or the like—such that a pulling head 64 axially engages a spring counterbearing 65 in the profiled unit 10. A spring cup 66 is longitudinally displaceable in a lower fixed sleeve 21 above the bottom pivot bearing 26 and supports the counterbearing 65. An upper polygonal sleeve 68 is rotatable relative to the fixed sleeve 21, eg by means of a wrench, for adjusting the preload of compression spring 67.

All and any of the features and advantages, including structural details, spatial arrangements and process steps as disclosed in the claims, description and drawings may be substantial for the invention both independently and in whatever combination.

LIST OF REFERTENCE CHARACTERS AND NUMERALS

A rotation axis
β angle
C ceiling/projection
D shower partition
ϵ eccentric throw
F spring assembly
L longitudinal direction
M mounting/supporting plate
P profiled sealing strip
R room wall
S swing door
T depth of groove
W shower basin or tub
10 profiled unit (shaped section)
11 profiled element
12 longitudinal groove
14 longitudinal groove
16 recess
18 extension
19 screw
20 main support
21 fixed sleeve
22 partial leaf
23 longitudinal edge
24 partial leaf
25 bore
26 bottom pivot bearing
27 bearing block
28 top pivot bearing
29 mating lug
30 flat element
31 back side
32 locking screw
33 threaded bore
34 threaded insert
35 depression
36 sliding blocks
37 snapping device
38 cover strip
39 snap-action catch
40 main profiled member
41 central channel
42 clamping surface
43 profiled clamping element
44 profiled clamping element
45 hooked end
46 clamp spring
47 sealing element
48 bearing surface
49 recess
50 mounting/supporting plate
51 adjusting screw
52 grub screw
53 handwheel
54 dog/entrainer
55 slide element
56 bush
57 eccentric/cam
58 stay bolt
59 fin
60 cable
61 pulling member
62 suspension screw
63 loop
64 pulling head
65 counterbearing
66 spring cup
67 compression spring
68 screw-threaded sleeve
69 supporting surface
70 handle
71 closing edge
72 sealing strips
73 pinning means
74 slide fins
75 screw-threaded region

The invention claimed is:

1. A shower partition (D) for a swing door (S) comprising:

at least one leaf (22) forming said swing door (S), wherein the swing door (S) comprises first and second partial leaves (22, 24);

a profiled unit (10) that extends over at least part of a vertical extension of the swing door (S), the profiled unit (10) being mounted at its ends by pivot bearings (26, 28) for rotation about a vertical axis (A), wherein the profiled unit (10) has opposing sides, one opposing side having one longitudinal groove (12), the one longitudinal groove (12) adapted to accommodate the leaf (22), with the other opposing side of the profiled unit (10) having a second longitudinal groove (14) positioned parallel to the first longitudinal groove and adapted to accommodate the second partial leaf 24; and means for positionally adjusting the leaf (22) in at least two spatial directions within the longitudinal groove (12) of the profiling unit (10) and the leaf (24) in at least two spatial directions within the longitudinal groove (14) of the profiling unit.

2. The shower partition as defined in claim 1, characterized in that the partial leaves (22, 24) are sealed or are adjustably clamped in the first and second longitudinal grooves (12, 14).

3. The shower partition as defined in claim 1, characterized in that at least parts of the partial leaves (22, 24) form a substantially plane door face, a rounded door face, or a combination thereof.

4. The shower partition as defined in claim 1, characterized in that the partial leaves (22, 24) are at an angle to each other or form an angle.

5. The shower partition as defined in claim 1, wherein the profiled element (11) is hollow and includes at least one flat element (30, 38) which is attachable to one of a front or rear of the profiled element (11), the at least one flat element (30, 38) being either flush, reentrant or projecting with respect to the profiled element (11).

6. The shower partition as defined in claim 5, the at least one flat element (30, 38) includes a gripping element.

7. The shower partition as defined in claim 5, characterized in that the at least one flat element (30, 38) is attachable to the profiled element (11) by means of frictional connections or form-fitting connections.

8. The shower partition having a profiled unit as defined in claim 1, the profiled unit (10) having a recess (16) at a bottom end thereof for accommodating a bottom pivot bearing (26), the profiled unit (10) adapted to be raised and lowered during swinging movement, and further adapted to be locked in at least one specific position of the swing door (S).

9. The shower partition as defined in claim 8, characterized in that said profiled unit (10) is braced at its top end against a room wall (R), a room ceiling or a ceiling projection (C).

10. A shower partition as defined in claim 8, wherein the profiled unit (10) has another recess (16) in a top end for accommodating a top pivot bearing (28) that is mounted to a room wall, ceiling, or ceiling projection.

11. A shower partition as defined in claim 8, further comprising a mounting plate (50) arranged on a bottom supporting surface, the mounting plate adapted to support the bottom pivot bearing (26) and the profiled unit (10), the mounting plate (50) adapted to be positionally adjusted and locked for alignment of the swing door (S).

12. The shower partition as defined in claim 11, characterized in that said base plate or support plate (50) is provided with setting means comprising adjusting and locking elements (51, 52) for compensating for inclines and angular or height deviations.

13. The shower partition as defined in claim 11, where the bottom supporting surface is any one of a floor, an edge of a shower basin, or an edge of a showertub.

14. The shower partition as defined in claim 8, wherein a closing edge (71) of the door leaf (22) is at least partly magnetic or has the magnetic element.

15. A shower partition as defined in claim 14, wherein the closing edge (71) includes a handle (70) with the magnetic element.

16. The shower partition, in particular as defined in claim 8, characterized in that the bottom pivot bearing (26) carries a spring assembly (F) on which the weight of the swing door rests and which is manually preloadable.

17. The shower partition as defined in claim 16, characterized in that the profiled unit (10) includes a handwheel (53) for a manually operable eccentric (57) by means of which a compression spring (67) is contractable or releasable for lowering or raising the door (S), respectively.

18. The shower partition as defined in claim 16, characterized in that for applying preload to the spring assembly (F), a manually operable eccentric (57) is provided which is engaged by a pulling member (61) of a cable or rod linkage (60), disposed in the profiled unit (10) such that tension forces act in a substantially axial direction.

19. The shower partition as defined in claim 16, characterized in that the spring assembly (F) is associated with a cable or rod linkage (60), by means of which a pulling head (64) engages a spring counterbearing (65) situated in a spring cup (66) at the bottom of the bottom pivot bearing (26) axially opposed thereto.

20. The shower partition as defined in claim 16, characterized in that an entrainer (54), non-rotatably connected to a handwheel (53), passes through the profiled unit (10) at its rear side (31) and comprises actuating means for a cable or rod linkage (60), engaging the lower end of said spring assembly (F).

21. The shower partition as defined in claim 16, characterized in that said spring assembly (F) includes a spring cup (66) that is longitudinally displaceable in a lower fixed sleeve (21) and includes an upper polygon-shaped sleeve (68), in that a compression spring (67) is enclosed under load between the sleeve ends and in that for adjusting the preload, the upper sleeve (68) is rotatable over a screw-threaded region (75) relative to the fixed sleeve (21).

* * * * *